US012571391B2

(12) United States Patent
Zhang et al.

(10) Patent No.: US 12,571,391 B2
(45) Date of Patent: Mar. 10, 2026

(54) HIGH-POWER FIVE-CYLINDER DRILLING PUMP SET, SOLID CONTROL SYSTEM AND DRILLING RIG

(71) Applicant: SICHUAN HONGHUA PETROLEUM EQUIPMENT CO., LTD, Guanghan (CN)

(72) Inventors: Fangfang Zhang, Guanghan (CN); Jian Cheng, Guanghan (CN); Junqing Chai, Guanghan (CN); Mingpeng Tang, Guanghan (CN); Hui Zeng, Guanghan (CN)

(73) Assignee: SICHUAN HONGHUA PETROLEUM EQUIPMENT CO., LTD, Guanghan (CN)

( * ) Notice: Subject to any disclaimer, the term of this patent is extended or adjusted under 35 U.S.C. 154(b) by 287 days.

(21) Appl. No.: 18/278,810

(22) PCT Filed: Jan. 25, 2022

(86) PCT No.: PCT/CN2022/073706
§ 371 (c)(1),
(2) Date: Aug. 24, 2023

(87) PCT Pub. No.: WO2023/273330
PCT Pub. Date: Jan. 5, 2023

(65) Prior Publication Data

US 2024/0125320 A1 Apr. 18, 2024

(30) Foreign Application Priority Data

Jun. 29, 2021 (CN) ..... 202110726364.8

(51) Int. Cl.
*F04B 53/18* (2006.01)
*E21B 7/00* (2006.01)
(Continued)

(52) U.S. Cl.
CPC ..... *F04B 53/18* (2013.01); *E21B 7/00* (2013.01); *F04B 1/0439* (2013.01); *F04B 1/053* (2013.01);
(Continued)

(58) Field of Classification Search
CPC ..... F04B 1/0439; F04B 1/053; F04B 1/00; F04B 17/03; F04B 53/08; F04B 53/18; E21B 7/00; E21B 21/00
(Continued)

(56) References Cited

U.S. PATENT DOCUMENTS 6,202,424 B1 * 3/2001 Hattori ..... F04C 29/0014 62/93
11,624,358 B2 * 4/2023 Netecke ..... F04B 51/00 73/152.61

FOREIGN PATENT DOCUMENTS

CN 102536792 A * 7/2012
CN 106089617 A * 11/2016 ..... F04B 1/00

OTHER PUBLICATIONS

Translation of CN-102536792-A (Year: 2018).*
Translation of CN-106089617-B. (Year: 2012).*

* cited by examiner

*Primary Examiner* — Charles G Freay

(57) ABSTRACT

A high-power five-cylinder drilling pump set includes: a base, a drilling pump arranged on the base, and a lubricating system arranged on the base, wherein the drilling pump comprises a transmission assembly, a power end assembly and a hydraulic end assembly; the lubricating system comprises a power end lubricating system for lubricating and cooling the transmission assembly as well as the power end assembly, and a hydraulic end lubricating system for lubricating and cooling the hydraulic end assembly. According to the present invention, the high-power five-cylinder drilling
(Continued)

pump set has a modular entire structure. In terms of the spatial layout, the present invention can effectively reduce the excessive size of conventional drilling pump or drilling pump structure. Based on the conventional structural design, the present invention simplifies the complex structure caused by intermediate mechanical speed change transmission mechanisms.

25 Claims, 15 Drawing Sheets

(51) Int. Cl.

| | |
|---|---|
| ***F04B 1/0439*** | (2020.01) |
| ***F04B 1/053*** | (2020.01) |
| ***F04B 17/03*** | (2006.01) |
| ***F04B 53/08*** | (2006.01) |
| *F04B 1/00* | (2020.01) |

(52) U.S. Cl.
CPC ..... *F04B 17/03* (2013.01); *F04B 53/08* (2013.01); *F04B 1/00* (2013.01)

(58) Field of Classification Search
USPC ..... 417/228
See application file for complete search history.

HIGH-POWER FIVE-CYLINDER DRILLING PUMP SET, SOLID CONTROL SYSTEM AND DRILLING RIG

BACKGROUND OF THE PRESENT INVENTION

Field of Invention

The present invention relates to a high-power five-cylinder drilling pump set, a solid control system and a drilling rig, which belongs to a technical field of oil drilling equipment.

Description of Related Arts

With the development of new drilling technologies such as deep/ultra-deep wells, high-pressure jet drilling, extended-reach horizontal wells, cluster wells, and offshore platforms, drilling pumps are required to have high power, large displacement, high pump pressure, high reliability, high efficiency and light weight. Conventionally, multi-stage transmission methods such as belt drive, chain drive or gear drive are generally used between the drilling pump body and the drive motor, which mainly have the following defects: first, there must be more mechanical loss, reducing the transmission efficiency and reliability of work; second, the operation and maintenance workload is heavy, boosting the use cost; third, the volume and weight are large, making it convenient for rapid transportation and transition and difficult to adapt to the increasingly high technical requirements of drilling technology. In view of such construction situation, oil service companies hope to design and manufacture a drilling pump set with small footprint, light weight, high efficiency and high power, so as to solve production problems.

SUMMARY OF THE PRESENT INVENTION

An object of the present invention is to provide a high-power five-cylinder drilling pump set for solving the above problems. Such drilling pump set has a simple structure, which is more compact compared with conventional structures. At the same time, the drilling pump set effectively improves work efficiency.

Accordingly, the present invention provides a high-power five-cylinder drilling pump set, comprising: a base, a drilling pump arranged on the base, and a lubricating system arranged on the base, wherein the drilling pump comprises a transmission assembly, a power end assembly and a hydraulic end assembly; the lubricating system comprises a power end lubricating system for lubricating and cooling the transmission assembly as well as the power end assembly, and a hydraulic end lubricating system for lubricating and cooling the hydraulic end assembly;

wherein the power end lubricating system comprises a skid seat; a lubricating oil pump is arranged on the skid seat; a filter for filtering lubricating oil is also arranged on the skid seat and communicates with the lubricating oil pump; the filter also communicates with the drilling pump and a cooler for cooling the lubricating oil; the filter comprises a temperature control switch, wherein the temperature control switch controls the lubricating oil from the filter to enter the drilling pump for lubricating and cooling, or to enter the cooler for cooling.

Preferably, the power end lubricating system adopts an air-cooled system or a water-cooled system.

Preferably, the power end lubricating system further comprises a lubricating oil inlet and a lubricating oil outlet; the lubricating oil pump comprises an oil pump inlet and an oil pump outlet; the lubricating oil inlet is connected to the oil pump inlet, and the lubricating oil outlet is connected to the drilling pump;

wherein the filter further comprises a filter oil inlet connected to the oil pump outlet; the filter further comprises a first filter oil outlet and a second filter oil outlet; the first filter oil outlet is connected to the cooler for cooling the lubricating oil, and the second filter oil outlet is connected to the lubricating oil outlet for sending the lubricating oil into the drilling pump.

Preferably, the cooler comprises a cooler oil inlet and a cooler oil outlet; the cooler oil inlet is connected to the first filter oil outlet, and the cooler oil outlet is connected to the lubricating oil outlet, in such a manner that the lubrication oil fluids into the drilling pump after being cooled.

Preferably, the power end lubricating system further comprises an oil spill pipeline; the oil spill pipeline is connected to a system oil pipeline through an overflow safety valve group; the overflow safety valve group detects an oil pressure, so as to control overflow of the lubricating oil.

Preferably, the cooler comprises a power module, a heat exchange module and a water curtain module; wherein the power module is cooled by air inhalation; and the power module comprises a motor and a cooling fan arranged on a rotor of the motor.

Preferably, the water curtain module comprises a casing, a cooling water curtain wall, an inlet water distribution pipe, a water outlet, and a water pool; wherein the casing comprises a cooling water inlet, and is connected to a water source through the inlet water distribution pipe; the water curtain module further comprises a water distribution device to drive water into a top of the cooling water curtain wall.

Preferably, the transmission assembly comprises a motor module, a transmission mechanism and a crank-link mechanism, wherein the motor module is connected and assembled to the crank-link mechanism through the transmission mechanism, thereby driving the crank-link mechanism to move by the motor module;

the power end assembly comprises multiple power units; one end of each of the power units is assembled and connected to the crank-link mechanism, and the other end is independently assembled with a piston mechanism of the hydraulic end assembly, thereby driving the hydraulic end assembly by the power end assembly.

Preferably, the transmission assembly comprises a frame; the motor module is arranged on the frame; the transmission mechanism comprises two driving wheels arranged on the motor module, and two driven wheels for driving the crank-link mechanism; the crank-link mechanism comprises a crankshaft to cooperate with the two driven wheels; wherein multiple support bearings and multiple connecting rods are assembled on the crankshaft.

Preferably, the two driving wheels are provided on both sides of the frame, and the two driven wheels are provided on both ends of the crankshaft; the motor module controls the two driving wheels to rotate synchronously, and the two driving wheels cooperate with the two driven wheels, so as to rotate the crankshaft.

Preferably, a rotating shaft is provided on both sides of the motor module, and both ends of the rotating shaft are fixed with the two driving wheels, wherein the two driving wheels are fixed on the rotating shaft, and synchronously rotates with the rotating shaft.

Preferably, the two driving wheels are assembled on the rotating shaft by interference fit;

each of the two driving wheels has a tapered hole, and each end of the rotating shaft is a tapered column, wherein the tapered hole and the tapered column are assembled through the interference fit, so as to facilitate disassembly of the two driving wheels; or, each of the two driving wheels has a cylindrical hole, and each end of the rotating shaft is a circular column, wherein the cylindrical hole and the circular column are assembled through the interference fit.

Preferably, the rotating shaft adopts an integral structure, or the rotating shaft adopts a split structure which is synchronously rotated by the motor module.

Preferably, multiple cranks are provided on the crankshaft; the crankshaft is fixed on the frame through multiple support bearings; the cranks are located between adjacent support bearings; and connecting rods are assembled on the cranks.

Preferably, there are six support bearings and five cranks.

Preferably, transmission between the driving wheels and the driven wheels is achieved through helical or straight tooth meshing; and a diameter of the driving wheels is smaller than a diameter of the driven wheels to realize a deceleration effect.

Preferably, the motor module is top-mounted, and adopts a permanent magnet integrated motor or a three-phase squirrel cage asynchronous motor.

Preferably, the power end assembly further comprises a crosshead box; the crosshead box has multiple crosshead chambers for assembling a crosshead structure; multiple connecting rods are arranged on the crank-link mechanism, and each of the multiple connecting rods is connected and assembled with a corresponding crosshead structure, in such a manner that the crosshead structure is driven by the connecting rods to perform a linear reciprocating motion.

Preferably, a box cover is provided on the crosshead box for covering the crosshead chambers;

wherein the box cover adopts an integral structure; or, the box cover adopts a split structure, comprising multiple cover units, wherein each of the crosshead chambers is provided with one of the cover units, so as to improve equipment maintenance efficiency.

Preferably, a crankcase is provided at a front end of the crosshead box for mounting the crank-link mechanism; a motor seat is provided above the crankcase, and bearing seats for mounting a motor shaft are provided on both sides of the motor seat; an end of the crosshead box, which is used for mounting the hydraulic end assembly, has a cylinder chamber, and a front board is provided at an end of the cylinder chamber for connecting the hydraulic end assembly.

Preferably, the hydraulic end assembly comprises a liquid intake module, a liquid discharge module, and a piston mechanism connected to the power end assembly; the hydraulic end assembly controls liquid intake and discharge through movement of the piston mechanism;

when the piston mechanism is contracted, the liquid intake module in-takes liquid; and when the piston mechanism is stretched, the liquid discharge module discharges the liquid.

Preferably, the hydraulic end assembly comprises a hydraulic end frame; the piston mechanism comprises a piston cylinder assembled on the hydraulic end frame, a piston rod arranged in the piston cylinder, and a piston head arranged at an end of the piston rod, wherein the other end of the piston rod is assembled with the power end assembly to operate the piston mechanism.

Preferably, an end of the power end assembly, which is used for assembling the hydraulic end assembly, has a cylinder chamber, and a front board is provided at an end of the cylinder chamber for connecting the hydraulic end assembly; the piston mechanism is assembled in the cylinder chamber for mounting the piston mechanism with the power end assembly; the hydraulic end frame is assembled with the front board through a bolt to complete whole device assembly.

Preferably, the piston cylinder is assembled on the hydraulic end frame through multiple cylinder liner bolts; a pressure plate is provided on the piston cylinder, and the cylinder liner bolts pass through the pressure plate and are fixed on the hydraulic end frame.

Preferably, a gland locking plate is provided at a front end of the pressure plate, which is positioned by cylinder liner nuts; one of the cylinder liner nuts is arranged at a rear end of the gland locking plate for fitting with the pressure plate for positioning, and another one of the cylinder liner nuts is provided at a front end of the gland locking plate, in such a manner that the gland locking plate is located between two of the cylinder liner nuts.

Preferably, a cylinder liner retracting mechanism is provided at a rear end of the pressing plate, comprising a positioning pin externally fixed on the piston cylinder, and a cylinder liner retracting disc capable of moving along an axis direction of the cylinder liner bolts; the cylinder liner nuts are also provided at an end of the cylinder liner retracting disc, and a limit block is set on the piston cylinder; front ends of the cylinder liner nuts are fitted and assembled with the limit block, and the cylinder liner retracting disc is fixed and assembled with the positioning pin;

when detaching a cylinder liner, the cylinder liner nuts at the front end of the pressure plate is withdrawn by a certain distance or totally removed, and the cylinder liner nuts at the rear end of the cylinder liner retracting disc are screwed to retract the piston cylinder.

Preferably, the liquid intake module comprises an intake port, a valve assembly and an intake cavity; with the piston mechanism, the valve assembly is opened or closed to control liquid intake at the intake port;

the liquid discharge module comprises a discharge port, the valve assembly and a discharge cavity, and the intake cavity communicates with the discharge cavity; with the piston mechanism, the valve assembly is opened or closed to control liquid discharge at the discharge port.

Preferably, a hoisting frame is arranged on the base, and a trolley is arranged on the hoisting frame, which is capable of sliding on the hoisting frame.

A solid control system is also provided, comprising the above high-power five-cylinder drilling pump set.

A drilling rig is also provided, comprising the above high-power five-cylinder drilling pump set.

To sum up, with the above technical solutions, beneficial effects of the present invention are as follows.

1. According to the present invention, the high-power five-cylinder drilling pump set, the solid control system and the drilling rig all have a modular entire structure. In terms of the spatial layout, the present invention can effectively reduce the excessive size of conventional drilling pump or drilling pump structure. Based on the conventional structural design, the present invention simplifies the complex structure caused by intermediate mechanical speed change transmission mechanisms such as belt drive and chain drive, so as to effectively optimize the entire structure.

2. Based on the motor design, one top-mounted motor is used for directly driving. The motor is above the frame, and small gears are directly thermally mounted on both sides of the motor shaft through conical surfaces, which simplifies the structure of the drilling pump and reduces the width, so as to meet shipping requirements.

3. With the five-cylinder design adopted by the present invention, discharge flow and pressure fluctuation are reduced by 16.5% compared with a three-cylinder drilling pump, and the pressure fluctuation under high pressure is only 2%-3%.

4. In terms of cooling system design, the lubricating cooling system adopts a specially designed water curtain air cooler. When the ambient temperature is relatively high (higher than 35° C.), the water curtain module can rapidly evaporate the water, thereby cooling the air entering the cooler by about 8-10° C. As a result, the present invention can effectively improve the heat exchange efficiency of the cooler in a high temperature environment, and ensures that the power end lubricating system can effectively control the system lubricating oil temperature in the high temperature environment, thereby ensuring the reliable operation of the lubricating system.

BRIEF DESCRIPTION OF THE DRAWINGS

The present invention will be further described with accompanying drawings.

Figure 1:
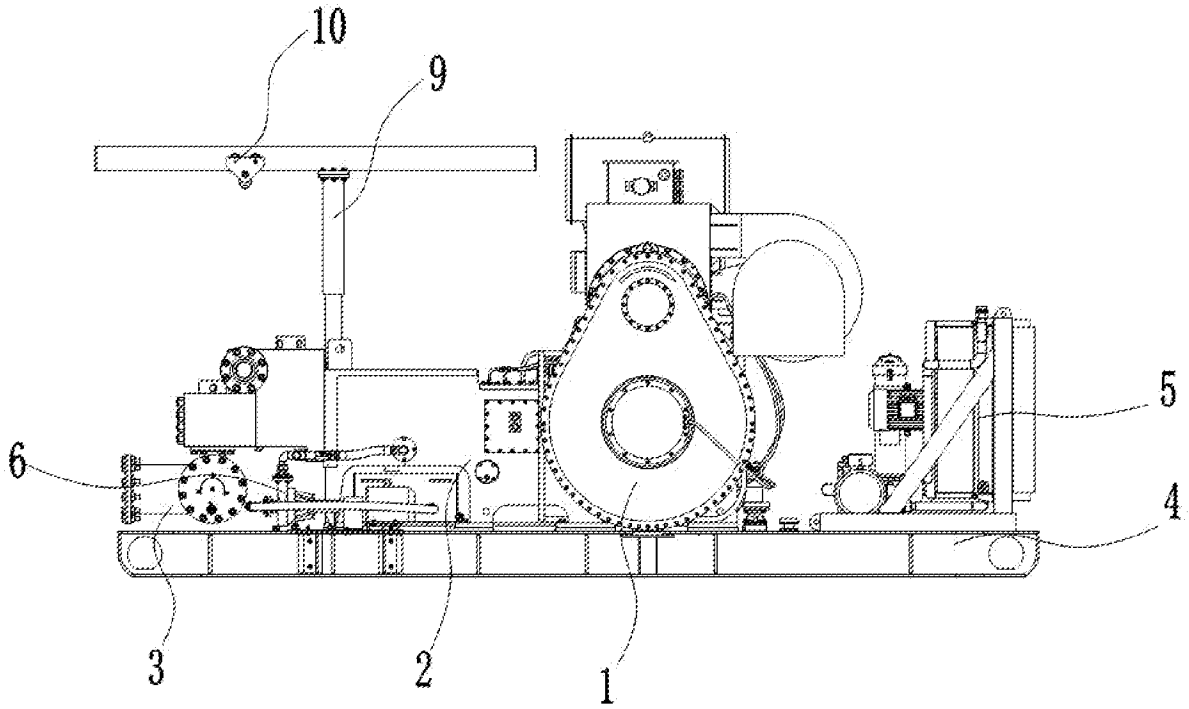
FIG. 1 is a structural view of the present invention.
Figure 2:
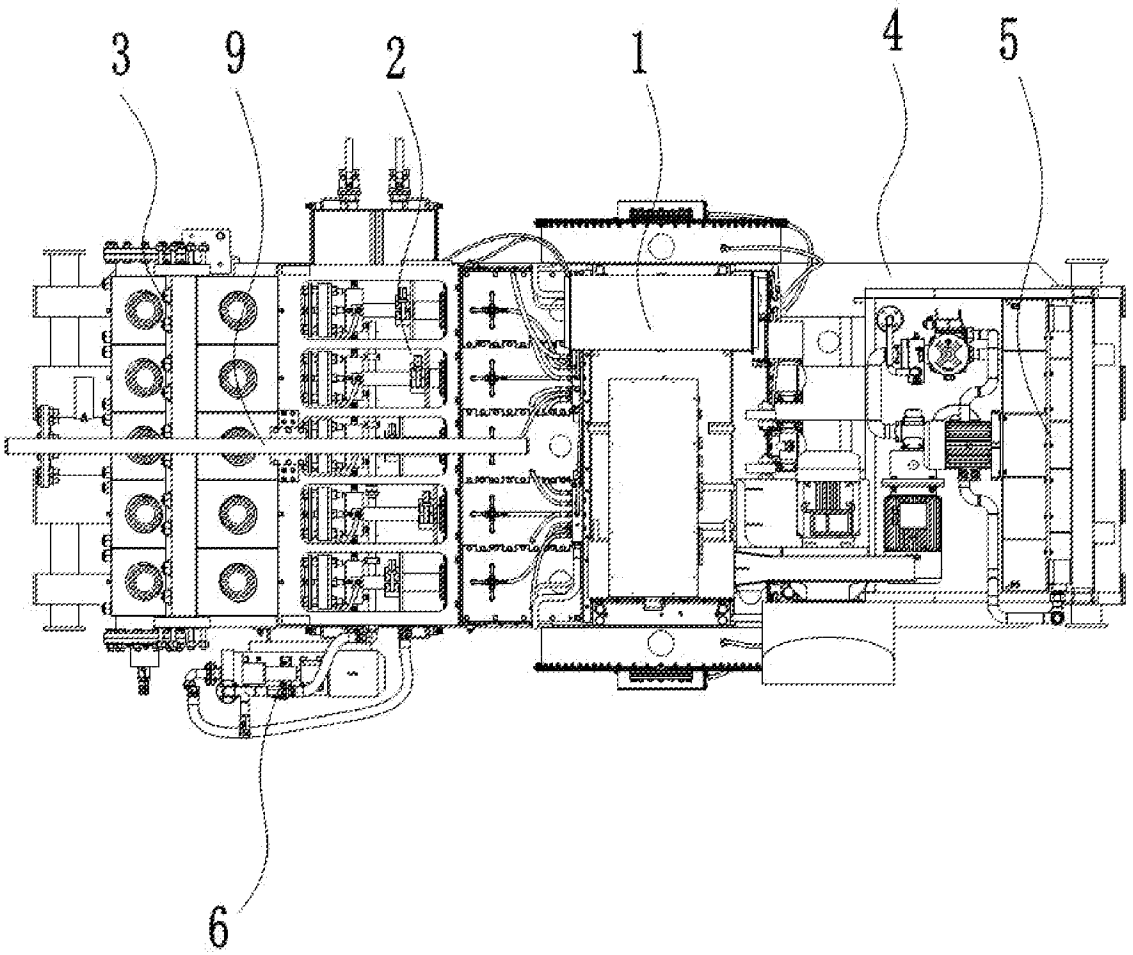
FIG. 2 is a top view of the present invention.
Figure 3:
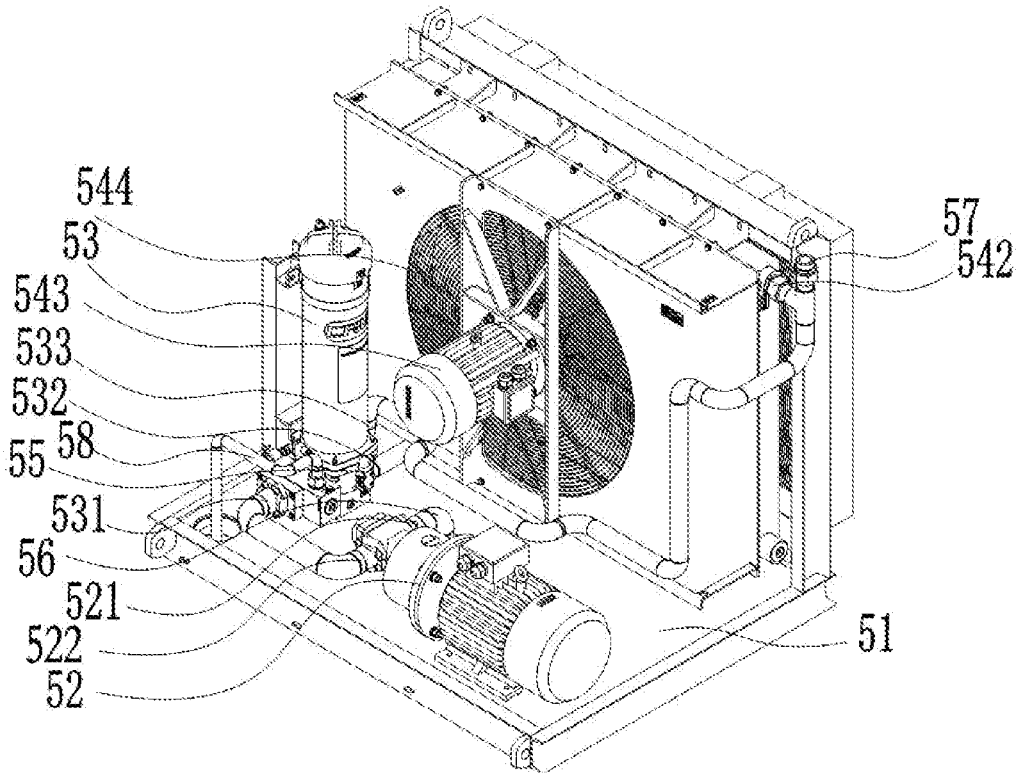
FIG. 3 is a structural view of a power end lubricating system of the present invention.
Figure 4:
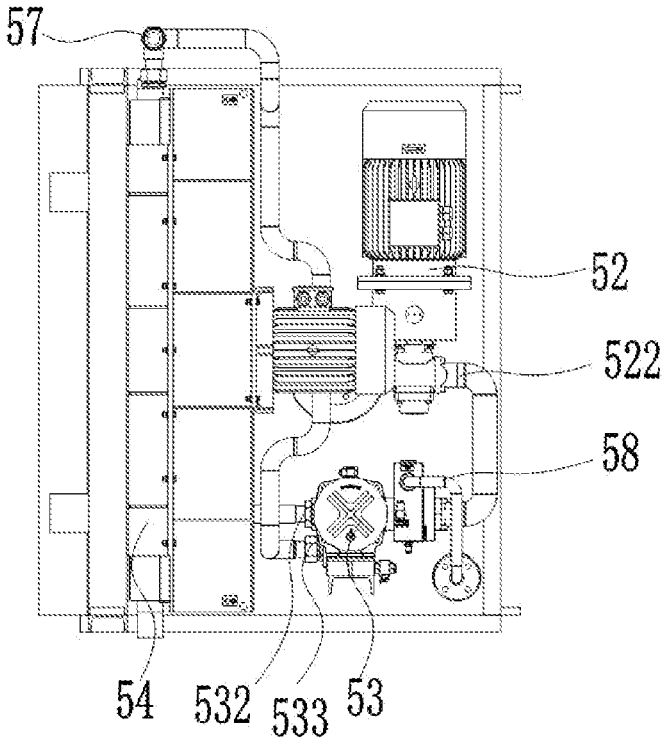
FIG. 4 is a top view of the power end lubricating system of the present invention.
Figure 5:
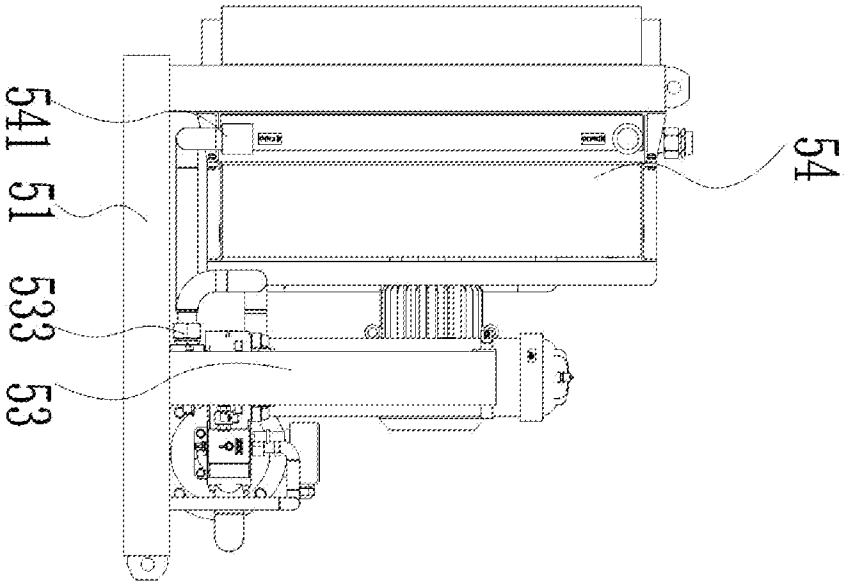
FIG. 5 is a side view of the power end lubricating system of the present invention.

Element reference: 1—transmission assembly, 11—motor module, 12—driving wheel, 13—drive wheel, 14—crankshaft, 15—support bearing, 16—connecting rod, 17—rotating shaft, 18—frame, 19—bearing seat, 110—crank, 111—crankcase, 112—motor seat, 2—power end assembly, 21—crosshead case, 22—crosshead structure, 221—slideway housing, 223—telescopic rod, 222—cross hinge, 23—crosshead chamber, 24—box cover, 25—cylinder chamber, 26—front board, 3—hydraulic end assembly, 31—hydraulic end frame, 32—piston cylinder, 33—piston rod, 34—piston head, 35—bolt, 36—cylinder liner bolt, 37—pressure plate, 38—gland locking plate, 39—cylinder liner nut, 310—positioning pin, 311—cylinder liner retracting disc, 312—intake port, 313—valve assembly, 314—intake cavity, 315—discharge port, 316—discharge cavity, 317—end flange, 318—limit block, 319—wear-resistant disc, 4—base, 5—power end lubricating system, 51—skid seat, 52—lubricating oil pump, 521—oil pump inlet, 522—oil pump outlet, 53—filter, 531—filter oil inlet, 532—first filter oil outlet, 533—second filter oil outlet, 54—cooler, 541—cooler oil inlet, 542—cooler oil outlet, 543—motor, 544—cooling fan, 55—temperature control switch, 56—lubricating oil inlet, 57—lubricating oil outlet, 58—oil spill pipeline, 6—hydraulic end lubricating system, 7—water curtain module, 71—casing, 711—cooling water inlet, 72—cooling water curtain wall, 73—inlet water distribution pipe, 74—water outlet, 75—water pool, 8—heat exchange module, 9—hoisting frame, 10—trolley.

DETAILED DESCRIPTION OF THE PREFERRED EMBODIMENT

All features disclosed herein, or all steps in a method or process disclosed herein, may be combined in any way except for mutually exclusive features and/or steps.

Any feature disclosed herein, unless expressly stated otherwise, may be replaced by other equivalent or alternative features serving a similar purpose. That is to say, unless expressly stated otherwise, each feature is but one example of a series of equivalent or similar features.

Embodiment 1

Referring to FIGS. 1-22 of the drawings, a high-power five-cylinder drilling pump set is illustrated, comprising: a base 4, a drilling pump arranged on the base, and a lubricating system arranged on the base, wherein the drilling pump comprises a transmission assembly 1, a power end assembly 2 and a hydraulic end assembly 3; the lubricating system comprises a power end lubricating system 5 for lubricating and cooling the transmission assembly 1 as well as the power end assembly 2, and a hydraulic end lubricating system 6 for lubricating and cooling the hydraulic end assembly 3;

wherein the power end lubricating system 5 comprises a skid seat 51; a lubricating oil pump 52 is arranged on the skid seat; a filter 53 for filtering lubricating oil is also arranged on the skid seat 51 and communicates with the lubricating oil pump 52; the filter 53 also communicates with the drilling pump and a cooler 54 for cooling the lubricating oil; the filter 53 comprises a temperature control switch 55, wherein the temperature control switch 55 controls the lubricating oil from the filter 53 to enter the drilling pump for lubricating and cooling, or to enter the cooler 54 for cooling.

According to the embodiment 1, based on the design of the drilling pump, the structure of the cooling system is further designed for the entire drilling pump set, wherein each unit is independently designed to effectively compact and simplify the entire structure. Specifically, in practice, the structure is simpler and occupies less space, providing more obvious advantages compared with conventional structures.

According to the above design, specifically, the power end lubricating system 5 adopts an air-cooled system or a water-cooled system.

Specifically, according the embodiment 1, the power end lubricating system 5 further comprises a lubricating oil inlet 56 and a lubricating oil outlet 57; the lubricating oil pump 52 comprises an oil pump inlet 521 and an oil pump outlet 522; the lubricating oil inlet 56 is connected to the oil pump inlet 521, and the lubricating oil outlet 57 is connected to the drilling pump;

wherein the filter 53 further comprises a filter oil inlet 531 connected to the oil pump outlet 522; the filter 53 further comprises a first filter oil outlet 532 and a second filter oil outlet 533; the first filter oil outlet 532 is connected to the cooler 54 for cooling the lubricating oil, and the second filter oil outlet 533 is connected to the lubricating oil outlet 57 for sending the lubricating oil into the drilling pump.

A purpose of the above design is to effectively cooling the lubricating oil. In practice, the lubricating oil can be further cooled by the above structure if a desired cooling temperature is not reached, in such a manner that the lubricating oil not only maintains a lubricating effect, but also provides a cooling effect.

According to the above design, preferably, the cooler 54 comprises a cooler oil inlet 541 and a cooler oil outlet 542; the cooler oil inlet 541 is connected to the first filter oil outlet 532, and the cooler oil outlet 542 is connected to the lubricating oil outlet 57, in such a manner that the lubrication oil fluids into the drilling pump after being cooled. As a result, the cooled lubricating oil is directly used for lubricating and cooling the drilling pump.

Specifically, the power end lubricating system 5 further comprises an oil spill pipeline 58; the oil spill pipeline 58 is connected to a system oil pipeline through an overflow safety valve group; the overflow safety valve group detects an oil pressure, so as to control overflow of the lubricating oil.

Based on the above design, specifically, the power end lubricating system is connected to each friction pair through a pipeline system. Pressure, temperature and other sensors are provided in the pipeline system, wherein operating parameters such as oil temperature and oil pressure are intelligently detected by an electronic control system.

In summary, the power end lubricating system provides the lubricating oil with a certain pressure to the friction pairs such as the power end bearings, gears, and crossheads for lubricating and cooling, which means the lubricating oil can take away the heat of the friction pairs.

Specifically, the hydraulic end lubricating system 5 adopts a water-cooled system for lubricating and cooling.

Based on the above design, specifically, a hoisting frame 9 is arranged on the base 4, and a trolley 10 is arranged on the hoisting frame 9, which is capable of sliding on the hoisting frame 9. In the following embodiments, the piston cylinder 32 is designed in the hydraulic end assembly 3, which should be assembled into the cylinder chamber 25 by the hoisting frame 9.

Embodiment 2

Figure 6:
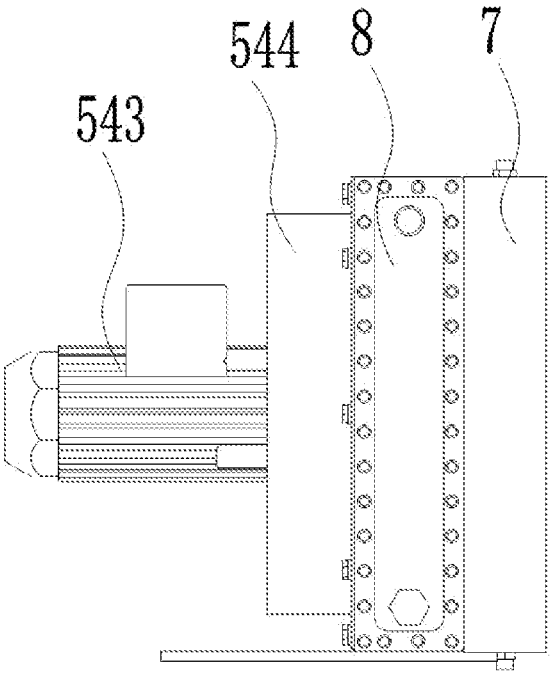
FIG. 6 is a structural view of a water curtain cooler of the present invention.
Figure 7:
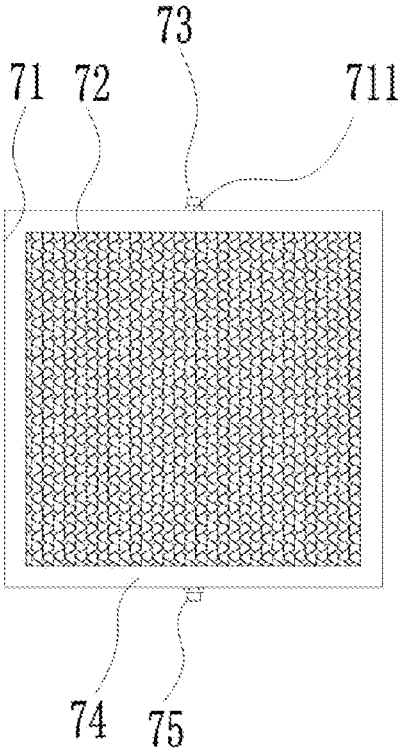
FIG. 7 is a sketch view of a water curtain module of the water curtain cooler of the present invention.
Figure 8:
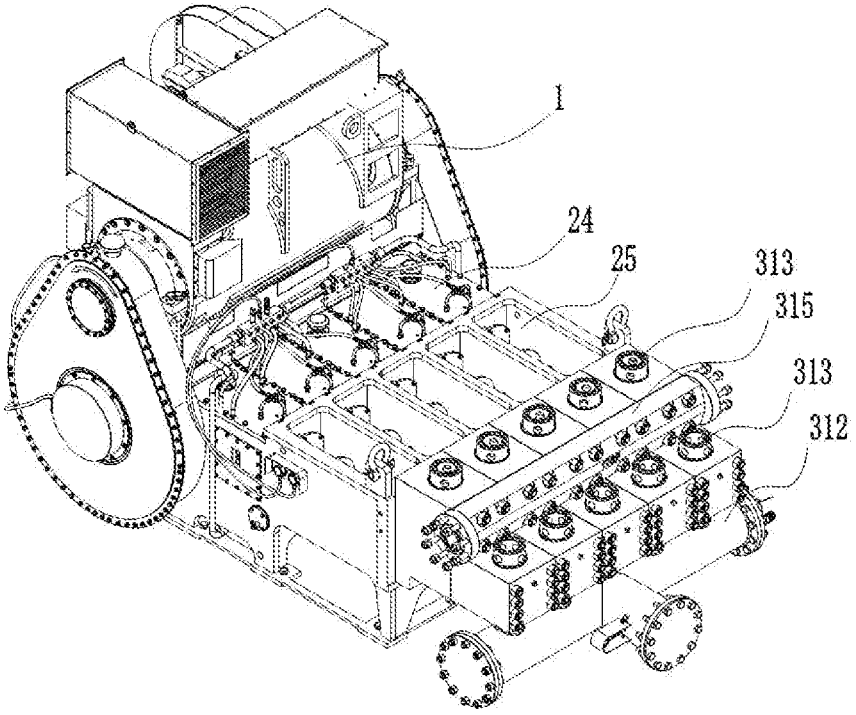
FIG. 8 is a structural view of an AC variable frequency drilling pump of the present invention.
Figure 9:
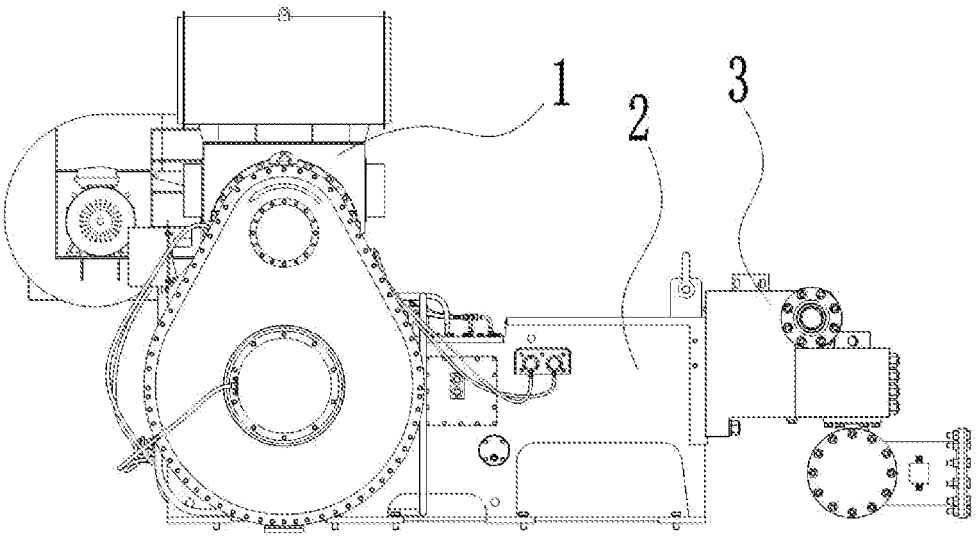
FIG. 9 is a front view of the AC variable frequency drilling pump of the present invention.
Figure 10:
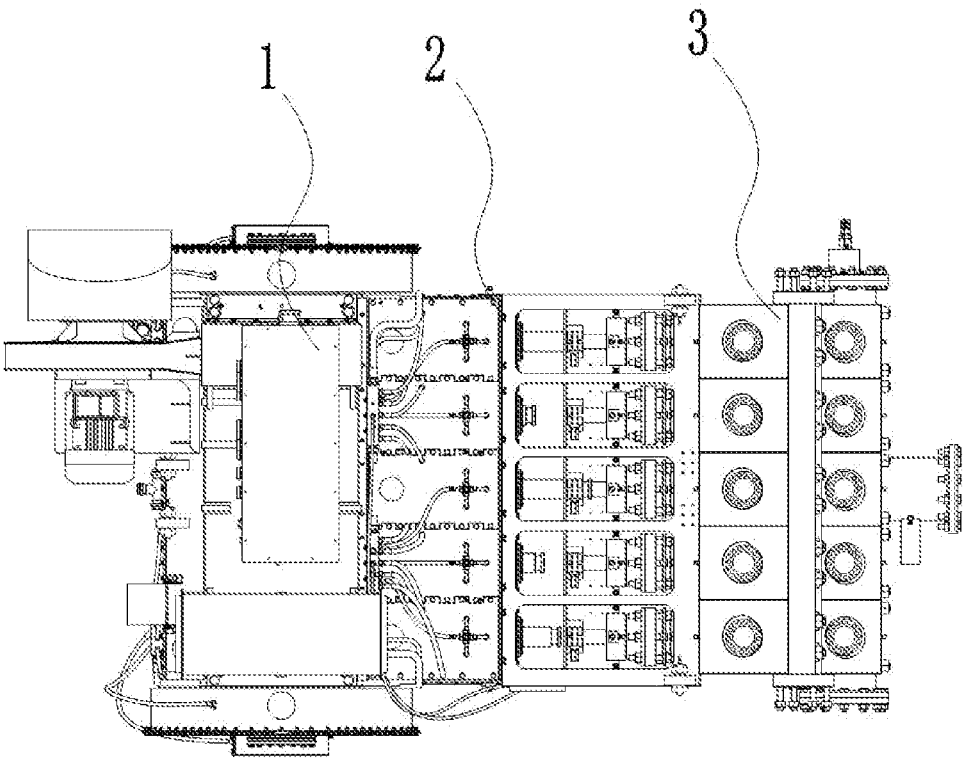
FIG. 10 is a top view of the AC variable frequency drilling pump of the present invention.
Figure 11:
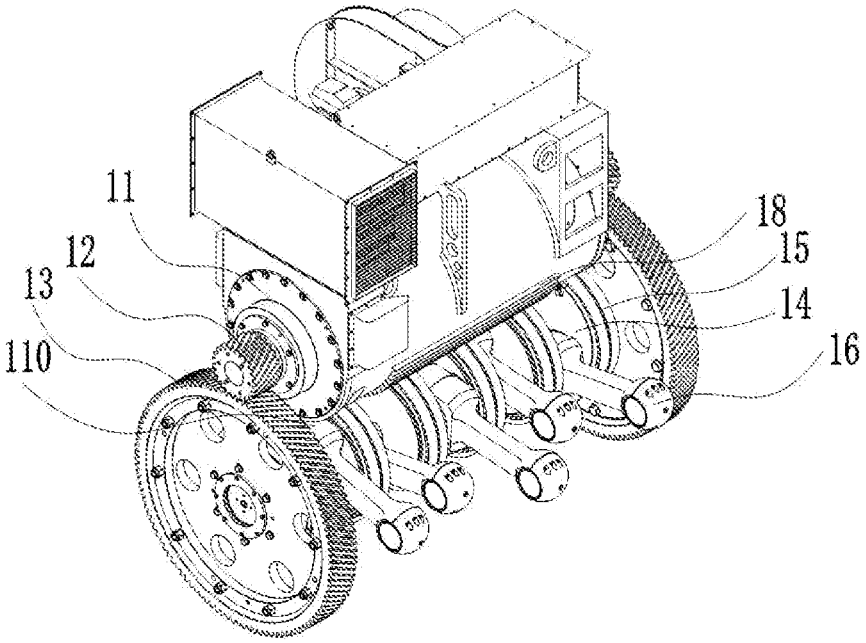
FIG. 11 is a structural view of a transmission assembly of the AC variable frequency drilling pump of the present invention.

Based on the embodiment 1, specifically, as shown in FIG. 6 and FIG. 7, the cooler 54 comprises a power module, a heat exchange module 8 and a water curtain module 7; wherein the power module is cooled by air inhalation; and the power module comprises a motor 543 and a cooling fan 544 arranged on a rotor of the motor.

In the embodiment 2, the heat exchange module 8 adopts a mature design, comprising a cooling coil with heat dissipation fins to increase a heat dissipation area. The power module mainly provides the power to draw the air, so that the air can pass through the water curtain module and then pass through the heat exchange module 8, thereby cooling the lubricating oil.

Specifically, based on the above design, the water curtain module 7 comprises a casing 71, a cooling water curtain wall 72, an inlet water distribution pipe 73, a water outlet 74, and a water pool 75; wherein the casing 71 comprises a cooling water inlet 711, and is connected to a water source through the inlet water distribution pipe 73; the water curtain module 7 further comprises a water distribution device to drive water into a top of the cooling water curtain wall.

In the embodiment 2, working principles are as follows. After the motor 543 is started, the air enters from the cooling water curtain wall 72, and then passes through a heat exchange pipe of the heat exchange module 8 to take away the heat. When the cooling water curtain wall 72 is connected to the water source, all surfaces of the water curtain wall are soaked, and a water film is formed on the surface. When the outside hot air passes through the water curtain, the water on the surfaces of the water curtain wall can quickly evaporate to absorb heat, thereby cooling the inlet air. As a result, the temperature of the air entering the heat exchange module 8 is greatly reduced, and a temperature difference between the air and the liquid to be cooled is enlarged, thereby improving the heat exchange efficiency and cooling effect of the cooler. The cooling water curtain wall 72 only needs to be wet, which means water evaporation and supply should be kept in balance. Therefore, only a small water flow is required. When the ambient temperature is relatively high (higher than 35° C.), the water curtain module 7 can rapidly evaporate the water, thereby cooling the air entering the cooler 5 by about 8-10° C. As a result, the present invention can effectively improve the heat exchange efficiency of the cooler in a high temperature environment, and ensures that the power end lubricating system can effectively control the system lubricating oil temperature in the high temperature environment, thereby ensuring the reliable operation of the lubricating system. The curtain module is only turned on when the ambient temperature is relatively high (higher than 35° C.) and the lubricating oil temperature cannot be effectively controlled within a desired range. There is no need to keep the water flowing for a long time, and no need to use a lot of water resources, so the working reliability of the lubricating system can be economically and effectively maintained at a relatively high temperature.

Embodiment 3

Based on the embodiment 1 and embodiment 2, specifically, as shown in FIGS. 8-22, the transmission assembly 1 comprises a motor module 11, a transmission mechanism and a crank-link mechanism, wherein the motor module 11 is connected and assembled to the crank-link mechanism through the transmission mechanism, thereby driving the crank-link mechanism to move by the motor module 11;

the power end assembly 2 comprises multiple power units; one end of each of the power units is assembled and connected to the crank-link mechanism, and the other end is independently assembled with a piston mechanism of the hydraulic end assembly 3, thereby driving the hydraulic end assembly 3 by the power end assembly 2.

In the embodiment 3, the drilling pump adopts a modular design. Specifically, the transmission assembly 1, the power end assembly 2 and the hydraulic end assembly 3 all adopt the modular design, which can effectively simplify the entire structure and provides better spatial simplification effect. At the same time, during maintenance of the entire equipment, such structure is easy to maintain, leading to better work efficiency.

Based on the above design, preferably, the transmission assembly 1 is optimized and further designed, comprising: a frame 18; the motor module 11 is arranged on the frame 18; the transmission mechanism comprises two driving wheels 12 arranged on the motor module 11, and two driven wheels 13 for driving the crank-link mechanism; the crank-link mechanism comprises a crankshaft 14 to cooperate with the two driven wheels 13; wherein multiple support bearings 15 and multiple connecting rods 16 are assembled on the crankshaft 14. According to the design, the motor module drives the crank-link mechanism through the transmission mechanism, which is a power output part of the whole equipment.

Preferably, based on the above design, the two driving wheels 12 are provided on both sides of the motor module 11, and the two driven wheels 13 are provided on both ends of the crankshaft 14; the motor module 11 controls the two driving wheels 12 to rotate synchronously, and the two driving wheels 12 cooperate with the two driven wheels 13, so as to rotate the crankshaft 14. In this design, the driving wheels 12 directly drive the driven wheels 13 to effectively simplify the complex structure caused by belt drive and the chain drive. More specifically, such structural design can effectively realize the modular design of the entire transmission assembly, and can realize the integration of the entire part, which is not only easy to install but also easy to transport due to a reduced number of parts.

Based on the above design, specifically, the frame 18 is further designed, which comprises a crankcase 111. A motor seat 112 is assembled with the crankcase 111, and bearing seats 19 for mounting a motor shaft are provided on both sides of the motor seat 112. According to the design, the motor seat 112 is designed for the motor module. At the same time, a connecting block is provided at a assembling position for preventing tilting. After the motor is assembled, it is fixed with the connecting block. The structure of the crankcase 111 is for assembling a crankshaft connection structure.

Based on the above design, specifically, a rotating shaft 17 is provided on both sides of the motor module 11, and both ends of the rotating shaft 17 are fixed with the two driving wheels 12.

The two driving wheels 12 are fixed on the rotating shaft 17. According to the embodiment 3, The two driving wheels 12 are fixed on the rotating shaft 17, and synchronously rotates with the rotating shaft 17. Preferably, the two driving wheels 12 are assembled on the rotating shaft 17 by interference fit.

For the interference fit, different implementation method can be used. Preferably, each of the two driving wheels 12 has a tapered hole, and each end of the rotating shaft 17 is a tapered column, wherein the tapered hole and the tapered column are assembled through the interference fit, so as to facilitate disassembly of the two driving wheels 12. Such structure is more convenient for maintenance, and once there is looseness during disassembly, the disassembly of the driving wheel 12 can be effectively realized.

Based on the above design, specifically, the rotating shaft 17 adopts an integral structure, or the rotating shaft 17 adopts a split structure which is synchronously rotated by the motor module. According to the structural design, preferably, the rotating shaft 17 adopts the integral structure, which means the driving wheels 12 are arranged coaxially. In particular, in order to ensure the rotation of the crankshaft 14, even if the split structure is adopted, namely the two driving wheels 12 are respectively connected to two rotating shafts, the rotation of the two driving wheels 12 is required to be synchronous.

Based on the above design, specifically, multiple cranks 110 are provided on the crankshaft 14; the crankshaft 14 is fixed on the frame 18 through multiple support bearings 15; the cranks 110 are located between adjacent support bearings 15; and connecting rods 16 are assembled on the cranks. In the field of engine, the crank 110 is assembled with the connecting rod having a larger end and a smaller end for driving, wherein the large end of the connecting rod 16 is assembled on the crank, and the other end is connected to a driven part.

Specifically, there are six support bearings 15 and five cranks 110. According to the design, a 5-cylinder structure is adopted, while the conventional structure is mostly 3-cylinder type. The difference is based on the entire structure. The structure of the present invention is simpler and more modular, while the conventional structure is relatively larger and has a complex structure, which causes the substantial difference in cylinder design.

The crankcase 111 and the crank-link mechanism are specifically designed, wherein the crankshaft 14 is forged from alloy steel. The crankshaft 14 consists of six journals and five cranks 110, wherein six support bearings are mounted on six bearing seats. The six bearing seats are integral crankshaft bearing seats, and the bearing seat on one side (preferably left) adopts a positioning spigot. After the crankshaft 14 is thermally fitted with a bearing liner and a cage, and then hoisted as whole into the bearing seat from a selected side, providing high installation accuracy and strong reliability. A crankshaft support structure of the five-cylinder drilling pump adopts a six-point support beam structure. Compared with a two-point support simplified beam structure of the conventional drilling pump, the main shaft bears less, the service life is longer, and the maintenance cost is effectively reduced.

Based on the above design, the driving wheels 12 and the driven wheels 13 are specifically designed, wherein:

1, the two driving wheels 12 and the two driven wheels 13 are engaged though helical teeth for transmission; and 2, the two driving wheels 12 and the two driven wheels 13 are engaged though straight teeth for transmission.

Specifically, the first engagement is preferred, namely helical teeth engagement. Such structure is more stable, especially during transmission; and its service life is also better.

Specifically, based on the engagement design, a diameter of the driving wheels 12 is smaller than a diameter of the driven wheels 13 to realize a deceleration effect.

Based on the above design, specifically, the motor module 11 is top-mounted. One top-mounted motor is used for directly driving. The motor is above the frame, and the driving wheels 12 are directly thermally mounted on both sides of the motor shaft through conical surfaces, which simplifies the structure of the drilling pump and reduces the width, so as to meet shipping requirements.

In the embodiment 3, specifically, as shown in FIGS. 7-11, the motor module 11 adopts a permanent magnet integrated motor.

The motor is integrated with an inverter, so as to omit a VFD room. The permanent magnet motor drives directly, leading to high efficiency and energy saving, low manufacturing cost, and low transportation cost. A power factor is increased from about 0.83 to 0.95 or above; a rated efficiency is increased from about 0.91 to about 0.968. The permanent magnet motor has a smaller current and a lower copper consumption, wherein a rated current is reduced by about 350 A under the same power. It has a flexible structure, a small size and high reliability. The permanent magnet motor relies on permanent magnets, so the rotor does not heat up, which means only the stator needs to be cooled by water. Compared with a variable frequency asynchronous motor, the permanent magnet motor can save energy by more than 10%, which greatly reduce the operating cost for customers.

Embodiment 4

Based on the embodiment 1, a difference is that the motor module 11, as shown in FIGS. 1-6, is an AC variable frequency motor, preferably a three-phase squirrel-cage asynchronous motor.

According to the embodiment 4, the AC variable frequency motor drives directly, wherein the transmission efficiency is improved by about 3%-5% compared with the conventional structure. Performance parameters of the AC variable frequency motor should meet the requirements of the drilling pump, and are manufactured according to an electromechanical integration design. As a result, the motor has a long life, high reliability and high stability, and on-site maintenance is convenient and quick. The motor makes full use of a constant power section for super large displacement output. A maximum displacement of the direct-drive drilling pump is 1.2-1.5 times that of the same-level drilling pump.

Embodiment 5

Based on the embodiment 1, the difference of the embodiment 5 is that the driving wheels 12 and the rotating shaft 17 are not assembled through the interference fit. Specifically, the driving wheels 12 are assembled on the rotating shaft 17 through a key connection.

Specifically, the structure of the embodiment 5 is also detachable, but the component subject to torque force during the rotation of the rotor is a key. Although the structure is detachable, its service life is not comparable to that of the tapered surface interference fit.

Embodiment 6

Based on the embodiment 1, the driving wheels 12 and the rotating shaft 17 are also assembled through the interference fit. However, each of the two driving wheels 12 has a cylindrical hole, and each end of the rotating shaft 17 is a circular column, wherein the cylindrical hole and the circular column are assembled through the interference fit.

In the embodiment 6, a conventional shaft hole and a conventional shaft are used for interference fit, which can balance the force during operation. However, the rotating shaft or the driving wheel may be damaged during disassembly. At the same time, the disassembly time is also prolonged, which is not conducive to efficient maintenance.

Embodiment 7

Figure 12:
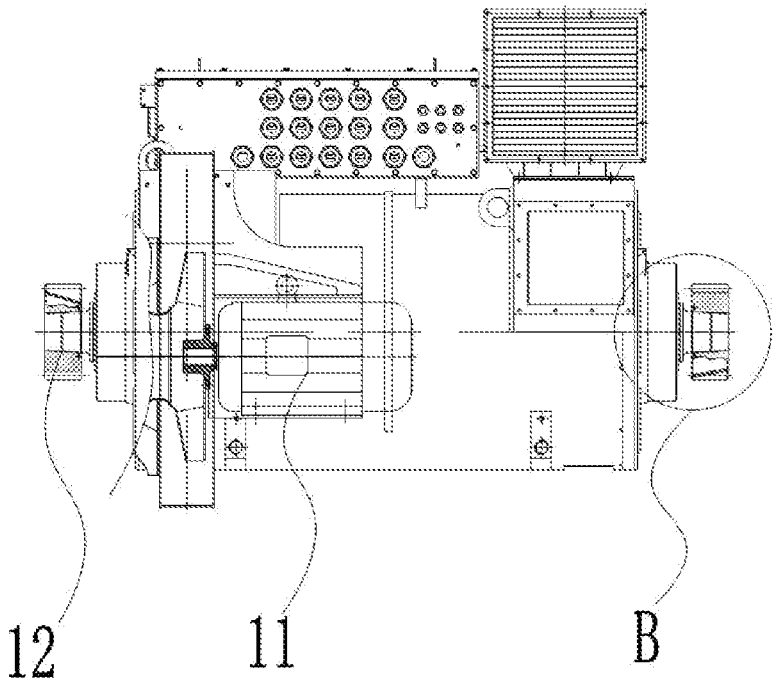
FIG. 12 illustrates assembly of driving wheels of the AC variable frequency drilling pump of the present invention.
Figure 13:
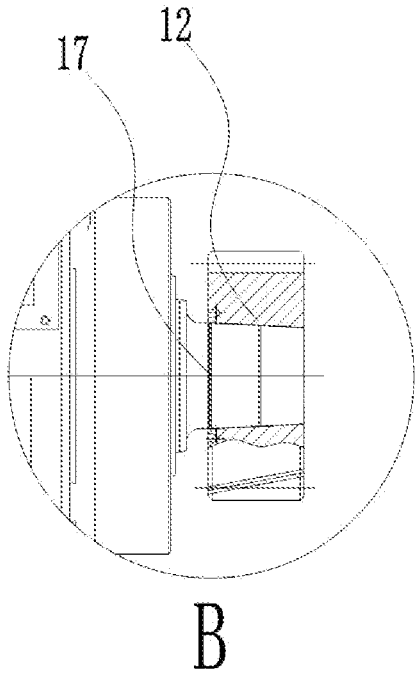
FIG. 13 is an enlarged view of part B in FIG. 12.
Figure 14:
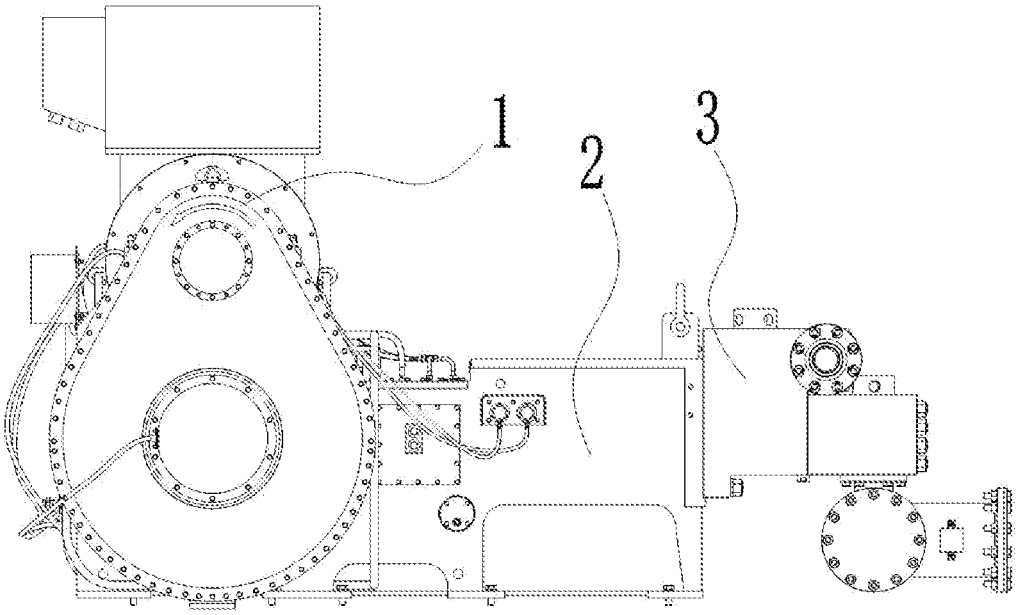
FIG. 14 is a front view of a permanent magnet variable frequency drilling pump of the present invention.

Based on the above embodiments, the power end assembly is further designed. Referring to FIGS. 12-14, the power end assembly 2 further comprises a crosshead box 21; the crosshead box 21 has multiple crosshead chambers 23 for assembling a crosshead structure 22; multiple connecting rods 16 are arranged on the crank-link mechanism, and each of the multiple connecting rods 16 is connected and assembled with a corresponding crosshead structure 22, in such a manner that the crosshead structure 22 is driven by the connecting rods 16 to perform a linear reciprocating motion.

In the embodiment 7, specifically, in order to better realize the design of the entire structure, the crosshead structure 22 is assembled with the connecting rod 16. Since the connecting rod 16 reciprocates, the crosshead structure 22 can perform the linear reciprocating motion, thereby realizing an effective driving effect.

Based on the above design, specifically, a box cover 24 is provided on the crosshead box 22 for covering the crosshead chambers 23.

According to the above design, considering the operation environment, the box cover 24 is provided on the crosshead box 22 for covering the crosshead chambers 23.

According to the embodiment 7, as a common design, the box cover 24 specifically adopts an integral structure.

Based on the design of the connection structure, specifically, a crankcase 111 is provided at a front end of the crosshead box 21 for mounting the crank-link mechanism; a motor seat 112 is provided above the crankcase 111, and bearing seats 19 for mounting a motor shaft are provided on both sides of the motor seat 112; an end of the crosshead box 21, which is used for mounting the hydraulic end assembly 3, has a cylinder chamber 26. Specifically, according to the design, the entire power end assembly 2 is an integral module. After all the modules are assembled together, the entire structure is effectively compacted, so as to further reduce the volume of the drilling pump.

Embodiment 8

Based on the embodiment 5, specifically, the box cover of the embodiment 8 adopts a different structure. Specifically, the box cover 24 adopts a split structure, comprising multiple cover units, wherein each of the crosshead chambers is provided with one of the cover units, so as to improve equipment maintenance efficiency.

In the embodiment 8, the conventional drilling pump adopts an integral cover structure, and the crosshead structure 22 can only be removed from a side opening. To remove the crosshead structure 22 of a middle cylinder, the crosshead structures 22 of the two side cylinders must also be removed. According to a comparison test in an assembly workshop, it will take 10 hours for 3 workers to detach and install the crosshead structure 22 of the middle cylinder in a conventional drilling pump, while in this design, it will take 3 hours for 2 works to detach and install the crosshead structure 22 of the middle cylinder in the five-cylinder drilling pump. This independent crosshead box with top opening greatly shortens the maintenance time for the customers. Specifically, the crosshead structure 22 comprises a slideway housing 221 to form a slideway, and a telescopic rod 223 in the slideway housing 221. The telescopic rod 223 is hinged to the end of the connecting rod 16 through a cross hinge 222, so as to change a movement direction.

Embodiment 9

Figure 15:
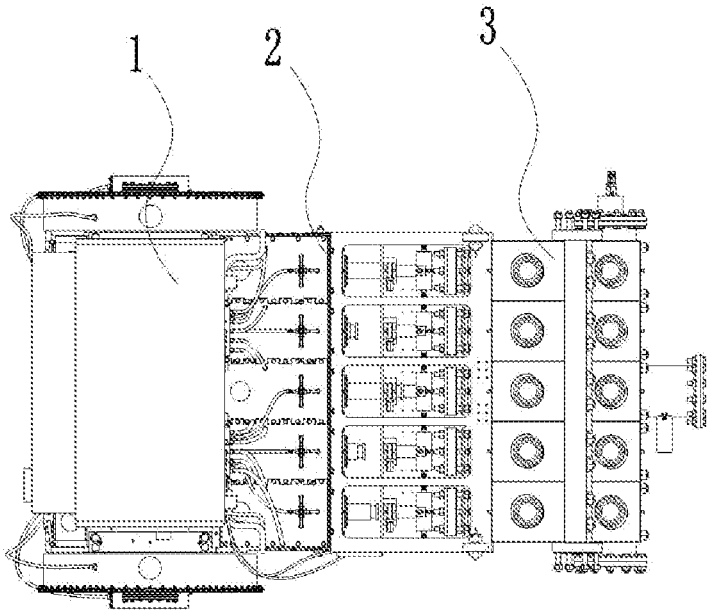
FIG. 15 is a top view of the permanent magnet variable frequency drilling pump of the present invention.
Figure 16:
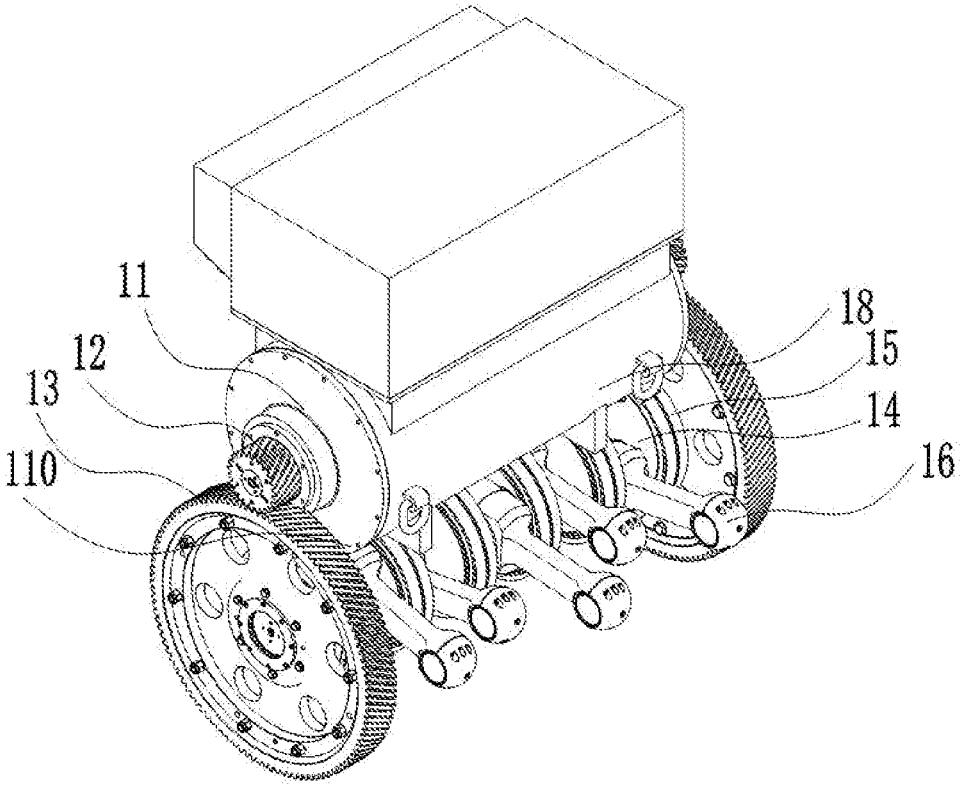
FIG. 16 is a structural view of a transmission assembly of the permanent magnet variable frequency drilling pump of the present invention.
Figure 17:
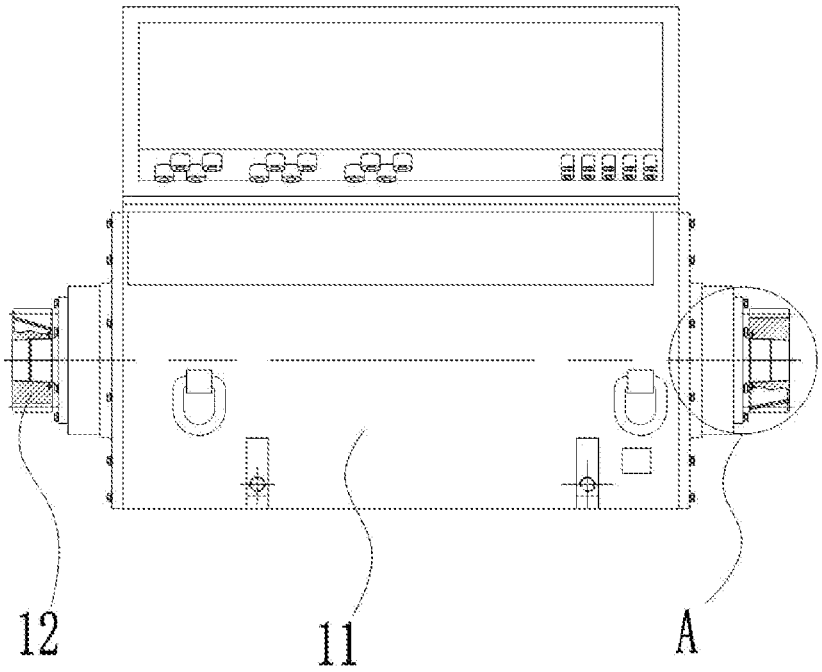
FIG. 17 illustrates assembly of driving wheels of the permanent magnet variable frequency drilling pump of the present invention.
Figure 18:
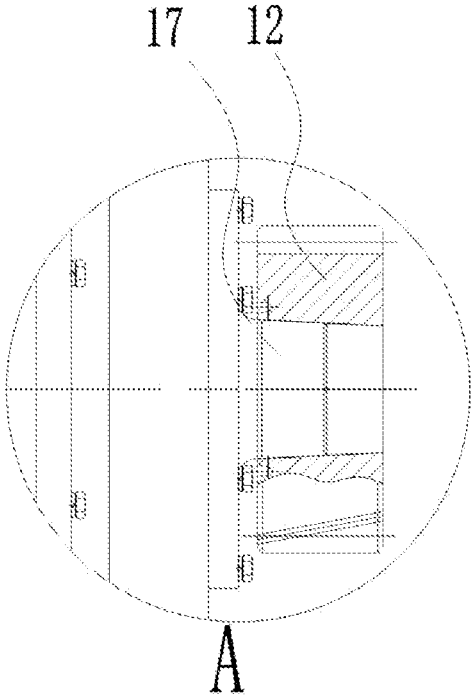
FIG. 18 is an enlarged view of part A in FIG. 17.
Figure 19:
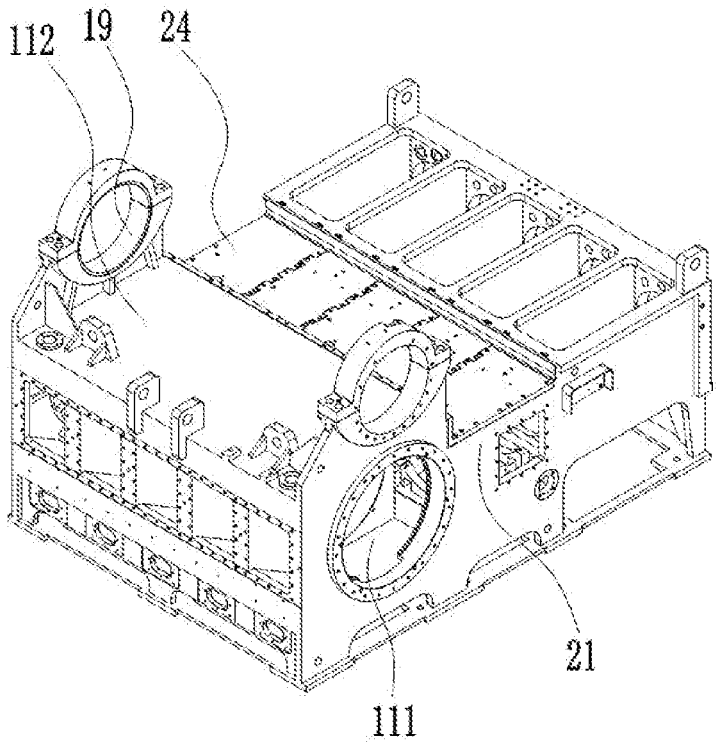
FIG. 19 is a structural view of a box of the present invention.
Figure 20:
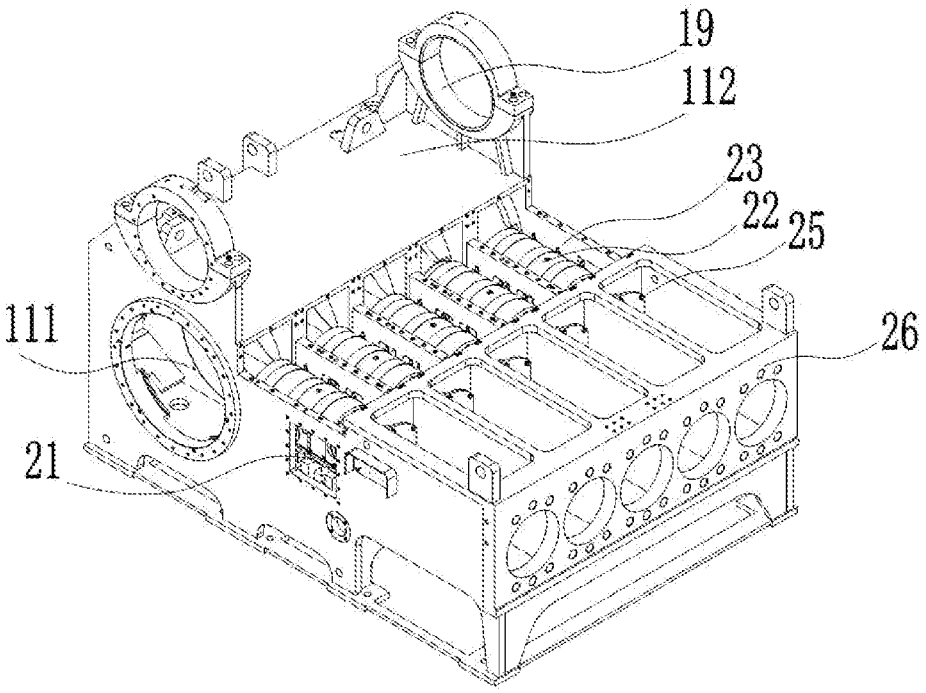
FIG. 20 is a structural view of a power end assembly of the present invention.
Figure 21:
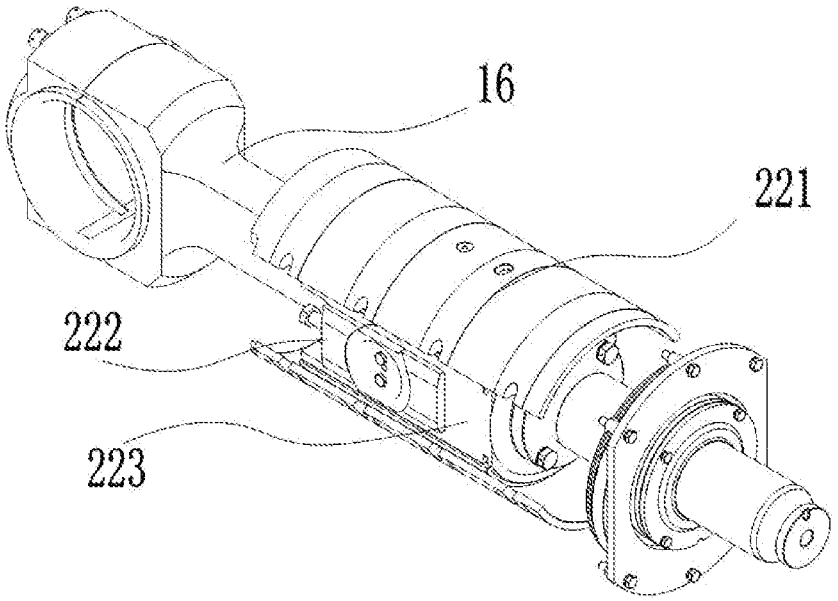
FIG. 21 illustrates assembly of a crosshead structure of the present invention.
Figure 22:
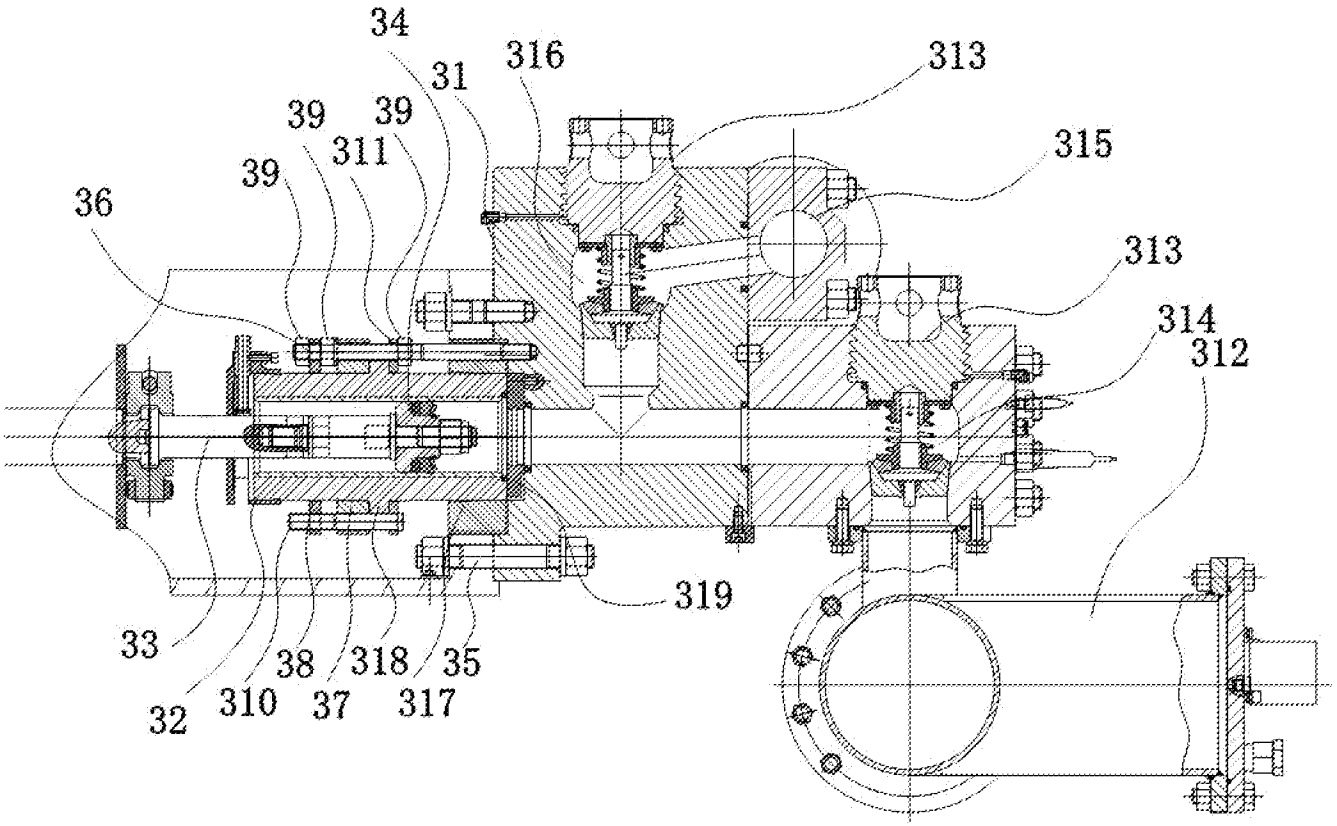
FIG. 22 is a structural view of a hydraulic end assembly of the present invention.

Based on the above design, the hydraulic end assembly is further designed. Referring to FIG. 15, the hydraulic end assembly 3 comprises a liquid intake module, a liquid discharge module, and a piston mechanism connected to the power end assembly; the hydraulic end assembly controls liquid intake and discharge through movement of the piston mechanism;

when the piston mechanism is contracted, the liquid intake module in-takes liquid; and when the piston mechanism is stretched, the liquid discharge module discharges the liquid.

In the structural design, the hydraulic end assembly takes advantage of the reciprocating motion of the piston mechanism. Moreover, with the liquid intake module and the liquid discharge module, entry and discharge of the liquid can be effectively realized. Especially, drilling fluid can be effectively circulated throughout the structure. At the same time, the whole structure also needs to be modularized.

Specifically, based on the above design, the hydraulic end assembly 3 of the embodiment 9 comprises a hydraulic end frame 31; the piston mechanism comprises a piston cylinder 32 assembled on the hydraulic end frame 31, a piston rod 33 arranged in the piston cylinder 32, and a piston head 34 arranged at an end of the piston rod 33, wherein the other end of the piston rod 33 is assembled with the power end assembly 2 to operate the piston mechanism. In the design of the structure, not only the assembly with a front-end device, but also the assembly of the structure itself should be considered, especially when the structure is modularized. Of course, the main purpose is also to effectively simplify and compact the structure. Specifically, the piston rod 33 is connected to the crosshead structure through a clamp.

Specifically, based on the above design, an end of the power end assembly 2, which is used for assembling the hydraulic end assembly, has a cylinder chamber 25, and a front board 26 is provided at an end of the cylinder chamber 25 for connecting the hydraulic end assembly 3.

Specifically, the piston mechanism is assembled in the cylinder chamber 25 for mounting the piston mechanism with the power end assembly 2.

Based on the above design, the hydraulic end frame 31 is assembled with the front board 26 through a bolt 35 to complete whole device assembly. According to the design, the bolts 35 is a stud bolt, and both ends thereof are tightened by nuts.

In the design, in order to assemble the piston cylinder at the end of the hydraulic end frame, the piston cylinder 32 is specifically assembled on the hydraulic end frame 31 through multiple cylinder liner bolts 36; a pressure plate 37 is provided on the piston cylinder 32, and the cylinder liner bolts 36 pass through the pressure plate 37 and are fixed on the hydraulic end frame 31. During operation, an end flange 317 is provided at the end of the piston cylinder 32. The cylinder liner bolts 36 are stud bolts. A limit block 318 is provided on the piston cylinder 32. The pressure plate 37 is assembled and fitted with the limit block 318. The cylinder liner bolts 36 pass through the pressure plate 37 and the limit block 318, and then pass through the end flange 317 to be assembled on the hydraulic end frame 31 through threads. A front end of the pressure plate 37 is engaged with a cylinder liner nut 39.

Based on the above design, to ensure an assembly effect, specifically, a gland locking plate 38 is provided at a front end of the pressure plate 37, which is positioned by cylinder liner nuts 39; one of the cylinder liner nuts 39 is arranged at a rear end of the gland locking plate 38 for fitting with the pressure plate 37 for positioning, and another one of the cylinder liner nuts 39 is provided at a front end of the gland locking plate 38, in such a manner that the gland locking plate 38 is located between two of the cylinder liner nuts 39, thereby further ensuring the assembly effect of the entire device.

Specifically, for convenient disassembly, a cylinder liner retracting mechanism is provided at a rear end of the pressing plate 37, comprising a positioning pin 310 externally fixed on the piston cylinder 32, and a cylinder liner retracting disc 311 capable of moving along an axis direction of the cylinder liner bolts 36; the cylinder liner nuts 39 are also provided at an end of the cylinder liner retracting disc 311, and a limit block 318 is set on the piston cylinder 32; front ends of the cylinder liner nuts 39 are fitted and assembled with the limit block 318, and the cylinder liner retracting disc 311 is fixed and assembled with the positioning pin 310;

when detaching a cylinder liner, the cylinder liner nuts 39 at the front end of the pressure plate 37 is withdrawn by a certain distance or totally removed, and the cylinder liner nuts 39 at the rear end of the cylinder liner retracting disc 311 are screwed to retract the piston cylinder 32.

In this structure, the cylinder liner nut at the front end is firstly disassembled. After the cylinder liner nut 39 at the front end of the pressure plate 37 is withdrawn, the cylinder liner nut 39 at the rear end of the cylinder liner retracting disc 311 can be screwed to push the cylinder liner retracting disc to drive the positioning pin 310, thereby driving the piston cylinder to move outwards for rapid disassembly.

Specifically, a wear-resistant disc 319 is also provided between assembly faces of the piston cylinder 32 and the hydraulic end frame 31 to improve the service life of the entire device.

Based on the above design, the liquid intake module and the liquid discharge module of the hydraulic end assembly 3 are designed, wherein:

the liquid intake module comprises an intake port 312, a valve assembly 313 and an intake cavity 314; with the piston mechanism, the valve assembly is opened or closed to control liquid intake at the intake port; and the liquid discharge module comprises a discharge port 315, the valve assembly 313 and a discharge cavity 316, and the intake cavity 314 communicates with the discharge cavity 316; with the piston mechanism, the valve assembly is opened or closed to control liquid discharge at the discharge port.

In the above design, specifically, a valve stem of the valve assembly 313 is an elastic member. To better illustrate the situation, when the piston is withdrawn, the valve assembly of the liquid intake module is opened upward under a suction force, and the liquid enters. At this time, the valve assembly of the liquid discharge module receives a downward force and remains closed. When the piston moves forward, an internal pressure applies a downward force on the valve assembly of the liquid intake module, and the liquid intake remains closed. At this time, the valve assembly of the liquid discharge module receives an upward force and is opened, thereby discharging the liquid.

Based on the above embodiments, in order to facilitate the hoisting of the entire drilling pump, the specific structure further comprises a hoisting lug for hoisting. Specifically, the direct-drive drilling pump has a small size and a light weight, which is suitable for installation in onshore pump rooms, offshore drilling platforms, transport trailers, and is suitable for helicopter hoisting.

Embodiment 10

A solid control system is also provided, comprising the high-power five-cylinder drilling pump set as recited in embodiments 1-9.

Embodiment 11

A drilling rig is also provided, comprising the high-power five-cylinder drilling pump set as recited in embodiments 1-9.

In summary:

1. According to the present invention, the high-power five-cylinder drilling pump set has a modular entire structure. In terms of the spatial layout, the present invention can effectively reduce the excessive size of conventional drilling pump or drilling pump structure. Based on the conventional structural design, the present invention simplifies the complex structure caused by intermediate mechanical speed change transmission mechanisms such as belt drive and chain drive, so as to effectively optimize the entire structure.

2. Based on the motor design, one top-mounted motor is used for directly driving. The motor is above the frame, and small gears are directly thermally mounted on both sides of the motor shaft through conical surfaces, which simplifies the structure of the drilling pump and reduces the width, so as to meet shipping requirements.

3. With the five-cylinder design adopted by the present invention, discharge flow and pressure fluctuation are reduced by 16.5% compared with a three-cylinder drilling pump, and the pressure fluctuation under high pressure is only 2%-3%.

4. In terms of cooling system design, the lubricating cooling system adopts a specially designed water curtain air cooler. When the ambient temperature is relatively high (higher than 35° C.), the water curtain module can rapidly evaporate the water, thereby cooling the air entering the cooler by about 8-10° C. As a result, the present invention can effectively improve the heat exchange efficiency of the cooler in a high temperature environment, and ensures that the power end lubricating system can effectively control the system lubricating oil temperature in the high temperature environment, thereby ensuring the reliable operation of the lubricating system.

The present invention is not limited to the foregoing embodiments, which intends to have any new features or any new combination disclosed in the specification involved in the protection scope, as well as any new method or process steps or any new combination thereof.

What is claimed is:

1. A five-cylinder drilling pump set, comprising: a base, a drilling pump arranged on the base, and a lubricating system arranged on the base, wherein the drilling pump comprises a transmission assembly, a power end assembly and a hydraulic end assembly; the lubricating system comprises a power end lubricating system for lubricating and cooling the transmission assembly as well as the power end assembly, and a hydraulic end lubricating system for lubricating and cooling the hydraulic end assembly;

wherein the power end lubricating system comprises a skid seat; a lubricating oil pump is arranged on the skid seat; a filter for filtering lubricating oil is also arranged on the skid seat and communicates with the lubricating oil pump; the filter also communicates with the drilling pump and a cooler for cooling the lubricating oil; the filter comprises a temperature control switch, wherein the temperature control switch controls the lubricating oil from the filter to enter the drilling pump for lubricating and cooling, or to enter the cooler for cooling.

2. The five-cylinder drilling pump set, as recited in claim 1, wherein the power end lubricating system comprises an air-cooled system or a water-cooled system.

3. The five-cylinder drilling pump set, as recited in claim 1, wherein the power end lubricating system further comprises a lubricating oil inlet and a lubricating oil outlet; the lubricating oil pump comprises an oil pump inlet and an oil pump outlet; the lubricating oil inlet is connected to the oil pump inlet, and the lubricating oil outlet is connected to the drilling pump;

wherein the filter further comprises a filter oil inlet connected to the oil pump outlet; the filter further comprises a first filter oil outlet and a second filter oil outlet; the first filter oil outlet is connected to the cooler for cooling the lubricating oil, and the second filter oil outlet is connected to the lubricating oil outlet for sending the lubricating oil into the drilling pump.

4. The five-cylinder drilling pump set, as recited in claim 3, wherein the cooler comprises a cooler oil inlet and a cooler oil outlet; the cooler oil inlet is connected to the first filter oil outlet, and the cooler oil outlet is connected to the lubricating oil outlet, in such a manner that the lubrication oil flows into the drilling pump after being cooled.

5. The five-cylinder drilling pump set, as recited in claim 3, wherein the power end lubricating system further comprises an oil spill pipeline; the oil spill pipeline is connected to a system oil pipeline through an overflow safety valve group; the overflow safety valve group detects an oil pressure, so as to control overflow of the lubricating oil.

6. The five-cylinder drilling pump set, as recited in claim 1, wherein the cooler comprises a power module, a heat exchange module and a water curtain module; wherein the power module is cooled by air inhalation; and the power module comprises a motor and a cooling fan arranged on a rotor of the motor.

7. The five-cylinder drilling pump set, as recited in claim 6, wherein the water curtain module comprises a casing, a cooling water curtain wall, an inlet water distribution pipe, a water outlet, and a water pool; wherein the casing comprises a cooling water inlet, and is connected to a water source through the inlet water distribution pipe; the water curtain module further comprises a water distribution device to drive water into a top of the cooling water curtain wall.

8. The five-cylinder drilling pump set, as recited in claim 1, wherein the transmission assembly comprises a motor module, a transmission mechanism and a crank-link mechanism, wherein the motor module is connected and assembled to the crank-link mechanism through the transmission mechanism, thereby driving the crank-link mechanism to move by the motor module.

9. The five-cylinder drilling pump set, as recited in claim 8, wherein the transmission assembly comprises a frame; the motor module is arranged on the frame; the transmission mechanism comprises two driving wheels arranged on the motor module, and two driven wheels for driving the crank-link mechanism; the crank-link mechanism comprises a crankshaft to cooperate with the two driven wheels; wherein multiple support bearings and multiple connecting rods are assembled on the crankshaft;

one driving wheel of the two driving wheels is provided on each side of the frame, and one driven wheel of the two driven wheels is provided on each end of the crankshaft; the motor module controls the two driving wheels to rotate synchronously, and the two driving wheels cooperate with the two driven wheels, so as to rotate the crankshaft;

a rotating shaft is provided having one end extending from each side of the motor module, and each end of the rotating shaft is fixed with one of the two driving wheels, wherein the two driving wheels are fixed on the rotating shaft, and synchronously rotate with the rotating shaft.

10. The five-cylinder drilling pump set, as recited in claim 9, wherein the two driving wheels are assembled on the rotating shaft by interference fit;

each of the two driving wheels has a tapered hole, and each end of the rotating shaft is a tapered column, wherein the tapered hole and the tapered column are assembled through the interference fit, so as to facilitate disassembly of the two driving wheels; or, each of the two driving wheels has a cylindrical hole, and each end of the rotating shaft is a circular column, wherein the cylindrical hole and the circular column are assembled through the interference fit.

11. The five-cylinder drilling pump set, as recited in claim 9, wherein the rotating shaft comprises an integral structure, or the rotating shaft comprises a split structure which is synchronously rotated by the motor module.

12. The five-cylinder drilling pump set, as recited in claim 9, wherein multiple cranks are provided on the crankshaft; the crankshaft is fixed on the frame through multiple support bearings; the cranks are located between adjacent support bearings; and connecting rods are assembled on the cranks.

13. The five-cylinder drilling pump set, as recited in claim 12, wherein there are six support bearings and five cranks.

14. The five-cylinder drilling pump set, as recited in claim 8, wherein transmission between the driving wheels and the driven wheels is achieved through helical or straight tooth meshing; and a diameter of the driving wheels is smaller than a diameter of the driven wheels to realize a speed reduction effect.

15. The five-cylinder drilling pump set, as recited in claim 8, wherein the motor module comprises a permanent magnet integrated motor or an AC variable frequency motor.

16. The five-cylinder drilling pump set, as recited in claim 8, wherein the hydraulic end assembly comprises a liquid intake module, a liquid discharge module, and a piston mechanism connected to the power end assembly; the hydraulic end assembly controls liquid intake and discharge through movement of the piston mechanism;

when the piston mechanism is contracted, the liquid intake module in-takes liquid; and when the piston mechanism is extended, the liquid discharge module discharges the liquid.

17. The five-cylinder drilling pump set, as recited in claim 16, wherein the hydraulic end assembly comprises a hydraulic end frame; the piston mechanism comprises a piston cylinder assembled on the hydraulic end frame, a piston rod arranged in the piston cylinder, and a piston head arranged at an end of the piston rod, wherein the other end of the piston rod is coupled to the power end assembly to operate the piston mechanism.

18. The five-cylinder drilling pump set, as recited in claim 17, wherein an end of the power end assembly mounts to the hydraulic end assembly and has a cylinder chamber, and a front board is provided at an end of the cylinder chamber for connecting the hydraulic end assembly; the piston mechanism is assembled in the cylinder chamber for mounting the piston mechanism with the power end assembly; the hydraulic end frame is assembled with the front board through a bolt.

19. The five-cylinder drilling pump set, as recited in claim 17, wherein the piston cylinder is assembled on the hydraulic end frame through multiple cylinder liner bolts; a pressure plate is provided on the piston cylinder, and the cylinder liner bolts pass through the pressure plate and are fixed on the hydraulic end frame.

20. The five-cylinder drilling pump set, as recited in claim 19, wherein a gland locking plate is provided at a front end of the pressure plate, which is restricted by cylinder liner nuts; one of the cylinder liner nuts is arranged at a rear end of the gland locking plate for fitting with the pressure plate, and another one of the cylinder liner nuts is provided at a front end of the gland locking plate, in such a manner that the gland locking plate is located between two of the cylinder liner nuts.

21. The five-cylinder drilling pump set, as recited in claim 20, wherein a cylinder liner retracting mechanism is provided at a rear end of the pressing plate, comprising a positioning pin externally fixed on the piston cylinder, and a cylinder liner retracting disc capable of moving along an axis direction of the cylinder liner bolts; the cylinder liner nuts are also provided at an end of the cylinder liner retracting disc, and a limit block is set on the piston cylinder; front ends of the cylinder liner nuts are fitted and assembled with the limit block, and the cylinder liner retracting disc is fixed and assembled with the positioning pin;

when detaching a cylinder liner, the cylinder liner nuts at the front end of the pressure plate are withdrawn by a certain distance or totally removed, and the cylinder liner nuts at the rear end of the cylinder liner retracting disc are screwed to retract the piston cylinder.

22. The five-cylinder drilling pump set, as recited in claim 16, wherein the liquid intake module comprises an intake port, an intake valve assembly and an intake cavity; the piston mechanism drives the intake valve assembly to open and close to control liquid intake at the intake port;

the liquid discharge module comprises a discharge port, a discharge valve assembly and a discharge cavity, and the intake cavity communicates with the discharge cavity; the piston mechanism drives the discharge valve assembly to open and close to control liquid discharge at the discharge port.

23. The five-cylinder drilling pump set, as recited in claim 1, wherein a hoisting frame is arranged on the base, and a trolley is arranged on the hoisting frame, which is capable of sliding on the hoisting frame.

24. A solid control system, comprising the five-cylinder drilling pump set as recited in claim 1.

25. A drilling rig, comprising the five-cylinder drilling pump set as recited in claim 1.

* * * * *